United States Patent [19]

Schwarting et al.

[11] 4,367,902

[45] Jan. 11, 1983

[54] TOOL FOR HYDROMECHANICAL OR HYDRAULIC MINING OR FOR CUTTING MINERAL OR BITUMINOUS MATERIALS

[75] Inventors: Karl H. Schwarting, Voerde; Heinrich Goris, Hamminkeln; Roland Günther, Wesel; Joachim Holz, Dortmund; Kurt Ogorek, Oberhausen, all of Fed. Rep. of Germany

[73] Assignee: Maschinenfabrik Augsberg-Nürnberg Aktiengesellschaft, Fed. Rep. of Germany

[21] Appl. No.: 232,559

[22] Filed: Feb. 9, 1981

[30] Foreign Application Priority Data

Feb. 14, 1980 [DE] Fed. Rep. of Germany ..... 3005486

[51] Int. Cl.[3] ..... E21C 27/18; E21C 25/60

[52] U.S. Cl. ..... 299/42; 299/17; 299/34; 299/81; 239/242; 239/DIG. 8

[58] Field of Search ..... 299/17, 34, 42, 81; 175/67; 239/242, DIG. 8

[56] References Cited

U.S. PATENT DOCUMENTS

| | | | |
|---|---|---|---|
| 3,379,379 | 4/1968 | Orem | 239/242 X |
| 3,645,346 | 2/1972 | Miller et al. | 175/393 X |
| 4,239,290 | 12/1980 | Goris et al. | 299/34 |

*Primary Examiner*—Ernest R. Purser

*Attorney, Agent, or Firm*—McGlew and Tuttle

[57] ABSTRACT

A tool for cutting a material along a path with a liquid jet directed onto the material for hydromechanical or hydraulic mining or for cutting mineral or bituminous material is disclosed. The tool includes a housing having an interior chamber with an opening adjacent the chamber. A nozzle body is mounted to the housing through the opening for swiveling motion about a swivel axis. The nozzle body has a first portion including a cylindrical stem symmetrically disposed about the swivel axis within the chamber and a second portion extending through the opening including a nozzle having a nozzle bore for discharging the liquid jet. A drive, operatively connected to the first portion, is provided for swiveling the nozzle body about the swivel axis.

16 Claims, 8 Drawing Figures

TOOL FOR HYDROMECHANICAL OR HYDRAULIC MINING OR FOR CUTTING MINERAL OR BITUMINOUS MATERIALS

FIELD AND BACKGROUND OF THE INVENTION

The invention relates, in general, to hydromechanical and hydraulic mining or cutting and, more particularly, to a tool for hydromechanical and hydraulic mining or for cutting mineral or bituminous materials.

It is well known that the cutting capability of a high speed liquid jet, directed perpendicularly onto the surface of a solid body and moved in translational motion along this surface, can almost be doubled by superimposing an oscillation in the same direction of the continuous translational advance motion, In this way, every individual point in the path is swept several times at a higher rate from different directions. The optimum sweeping speed, depending on a number of parameters, is on the order of magnitude of ten meters per second.

To utilize this improved cutting performance, based on the so-called air hammer effect, the cutting nozzle is reciprocated in translational motion perpendicularly to its longitudinal axis, in the advance direction, or caused to oscillate about an axis which is normal to the advance direction.

The unhindered oscillation of the nozzle is assured only if the nozzle is accommodated in a proper protective housing. Otherwise, it may be blocked or damaged by the material broken up during the cutting operation.

Enclosing the mounting of the nozzle, its swiveling mechanism and drive, however, does not ensure reliable operation so long as water having fine material can penetrate into the aperture through which the jet is discharged.

A known tool of the above-mentioned kind houses an oscillatory nozzle that is driven by a motor through a coupling bar. The elements of the swivel drive of the nozzle partly execute both a rotary and a translational motion. The rotary parts may be only partly axially symmetrical. Even though the housing has small jet discharge apertures, the water with fine material penetrates into the housing. Deposits of such fine material between the fixed and the moving parts of the swivel drive necessarily cause troubles in the operation of the drive. Since mud and water continually penetrate to the swivel drive, an expensive mounting and sealing must be provided for the individual joints.

SUMMARY OF THE INVENTION

The invention is directed to an improved tool for cutting mineral or bituminous materials in hydromechanical or hydraulic mining operations having rotary parts which are completely symmetrical about their axis, arranged so that water as well as solid matter cannot penetrate into the housing and swivel drive parts for executing a translational motion.

Accordingly, it is an object of the invention to provide a tool for cutting a material along a path with a liquid jet directed onto the material which includes a housing having an interior chamber with an opening adjacent to the chamber, a nozzle body, means for mounting the nozzle body to the housing through the opening for swiveling motion about a swivel axis, the nozzle body having a first portion including a cylindrical stem symmetrically disposed about the swivel axis within the chamber and a second portion extending through the opening including a nozzle having a nozzle bore for discharging the liquid jet, and drive means, operatively connected to the first portion, for swiveling the nozzle body about the swivel axis.

In accordance with a preferred embodiment of the invention, a torque motor surrounding the stem of which the nozzle body may be designed as an integral part includes means defining a circular channel about the stem and the stem has a lengthwise bore therein communicating with the nozzle bore and at least one radial bore radially extending through the stem to establish fluid communication between the circular channel and the lengthwise bore. The drive means preferably includes an eccentric member mounted in the chamber for rotation, a sliding member slidably mounted in the housing, the sliding member being operatively connected to the eccentric member and the nozzle body for rectilinear movement transversely to the swivel axis, and the nozzle body being operable to swivel responsive to the rectilinear motion of the sliding member.

It is a further object of the invention to provide a tool for cutting a material along a path with a liquid jet and, more particularly, a tool for hydromechanical or hydraulic mining or for cutting mineral or bituminous materials which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its use, reference is made to the accompanying drawings and descriptive matter in which preferred embodiments of the invention are illustrated.

DETAILED DESCRIPTION

Figure 1:
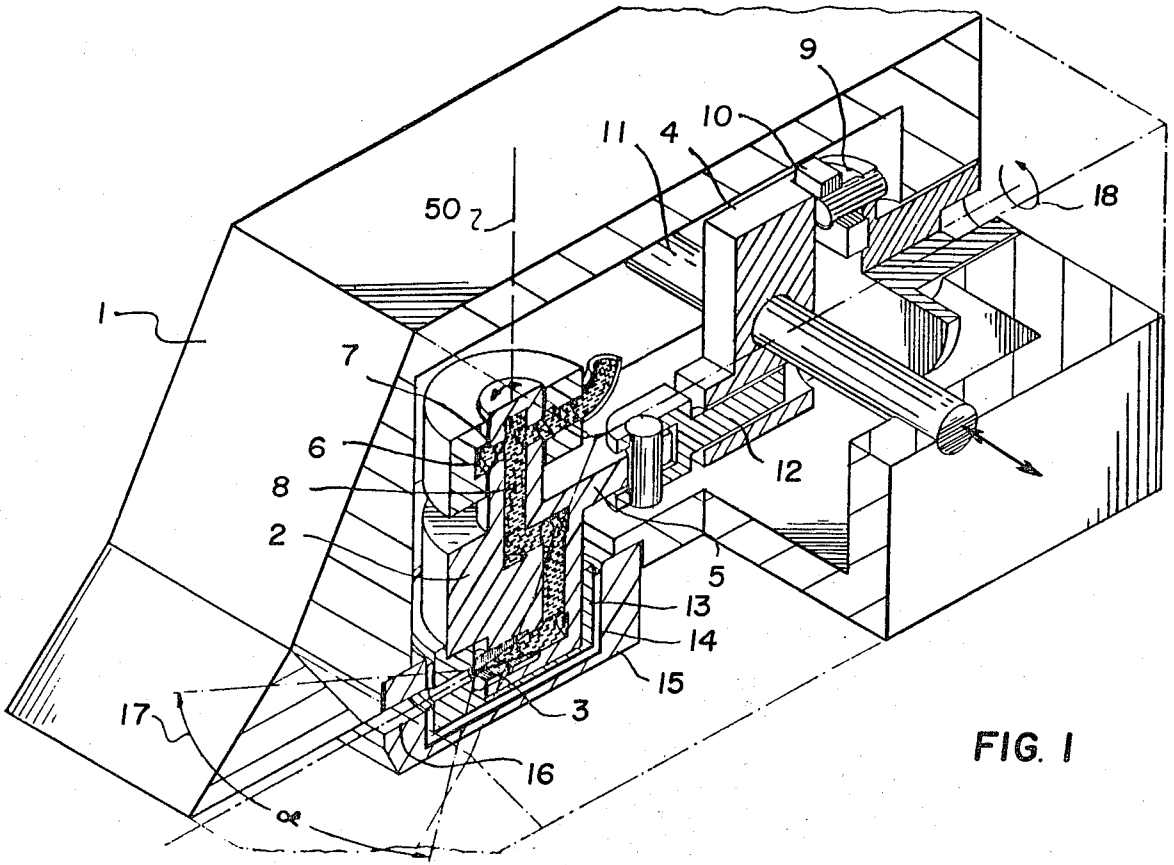
FIG. 1 is a perspective view, partly in section, of a tool according to the invention.
Figure 2:
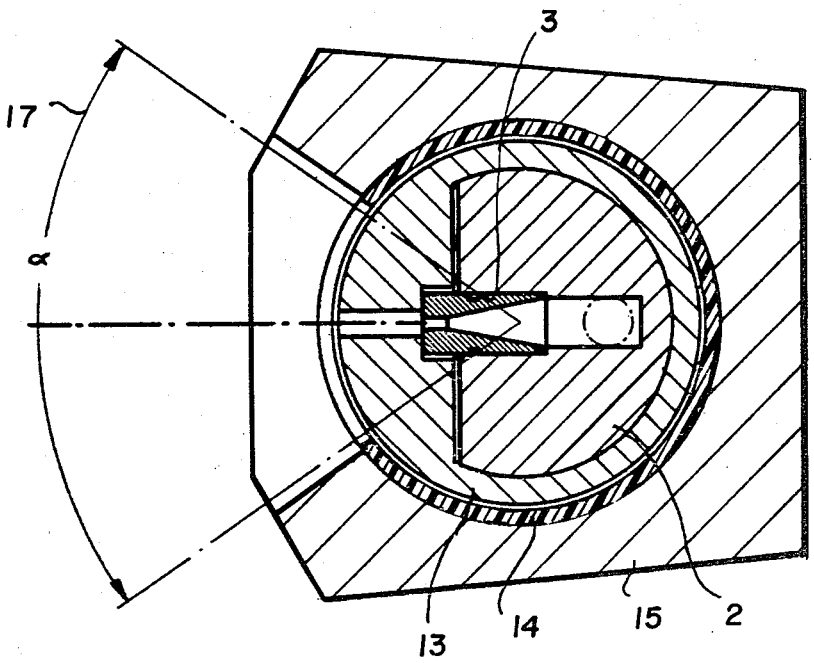
FIG. 2 is a partial horizontal section of the tool.

Referring now to the drawings wherein like reference characters designate like or corresponding parts throughout the several views, there is shown a housing 1, a nozzle body 2 having a nozzle 3 is mounted in the housing for swiveling motion. A swivel drive or drive mechanism 4, which is to be described, is provided within the housing to effect the positioning of the nozzle body 2.

The nozzle body 2 as shown in FIG. 1, is provided with a cylindrical part, in the form of an upwardly extending upper stem or shaft-end which incorporates a central bore 8, which is connected at its lower end to the main portion of the nozzle body. The cylindrical part is symmetrically disposed about a swivel axis 50. The nozzle body includes a coupling element 5 which is driven by the drive mechanism 4. The upper stem is mounted for swiveling in a bore having a circular channel 6 communicating with the central bore 8 through at least one bore 7 radially extending through the stem within the vicinity of the circular channel. Nozzle 3 is provided at the lower end of the generally cylindrical nozzle body 2 and extends perpendicularly to the swivel axis. Nozzle 3 has a cylindrical outer surface with an annular groove 51 formed thereon for receiving a seal ring.

Nozzle 3 is inserted in a smooth receiving bore provided in the lower end portion of nozzle body 2. The nozzle is fixed in position by a cylindrical element 13 which is engaged over the lower end nozzle body 2 and in turn mounted for swiveling in a socket 14 of soft material.

The outer contact surface of cylindrical element 13 is hardened or coated with a ceramic material.

Socket 14 of soft material is press-fitted in a removable cover 15 of housing 1. Both cover 15 and socket 14 of soft material are designed with a narrow slot 16 which extends over the sweeping range 17 of liquid jet covering and angle alpha of ±40° at most.

Rotary motion, as illustrated by arrow 18, produced by a drive (not shown), is transformed by swivel drive mechanism 4 in housing 1 into a translational reciprocating motion. This motion is transmitted through a coupling bar 12 to the nozzle body 2, so that the body executes a swiveling motion. The liquid jet discharged from the nozzle can thus cover a definite sweep angle.

More particularly, in the tool shown in FIG. 1, the swivel drive 4 comprises a driven eccentric 9 by which a sliding member 10 is reciprocated in translational motion on a guide 11 extending transversely to the longitudinal axis of the tool housing. Sliding member 10 is hinged to swiveling nozzle body 2 through the coupling bar 12 which is displaceable in its longitudinal direction.

Figure 3:
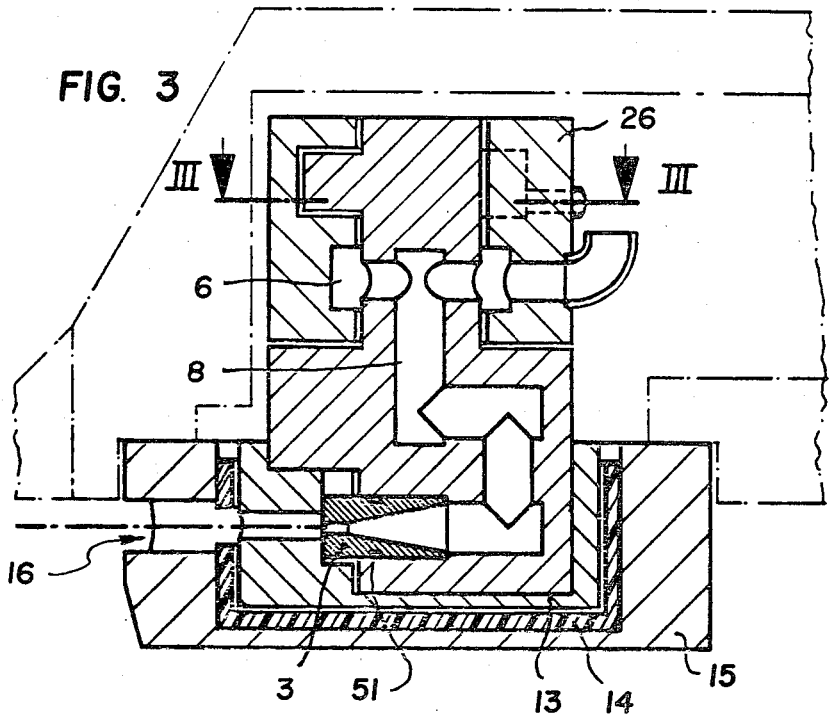
FIG. 3 is a vertical section of a swivel drive with the nozzle body according to an embodiment of the invention.
Figure 3A:
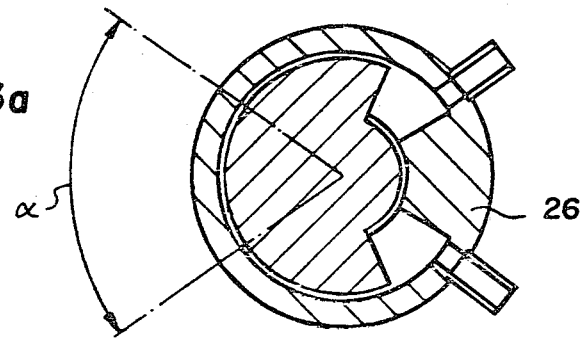
FIG. 3*a* is a section taken along the line III—III of FIG. 3.

FIG. 3 shows another embodiment of the invention. In this design, the swiveling motion is imparted to a nozzle body by a torque motor. Torque motor 26 is mounted above the nozzle body within the housing of the tool. In accordance with the invention, the nozzle body may also be designed as a part of the torque motor.

Figure 4:
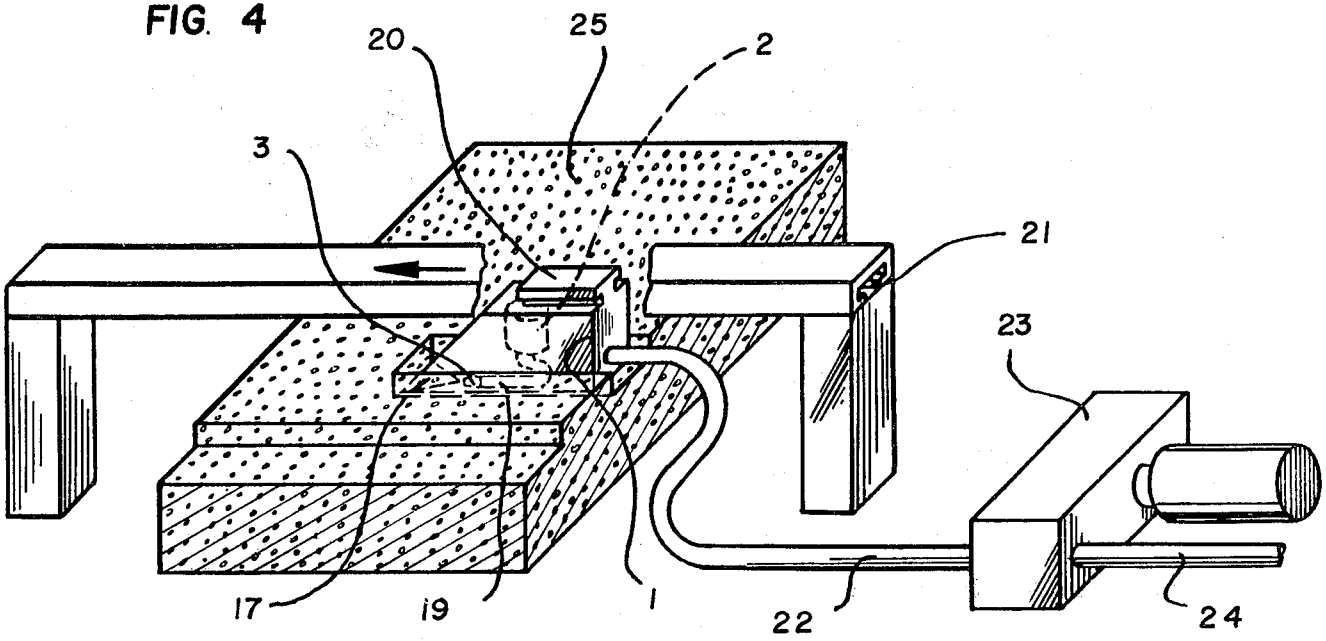
FIG. 4 is a perspective view showing the tool as used for making a groove in a structural part.

FIG. 4 shows how the inventive tool is employed to make a groove in a constructional part 25 for example, a paving coat and its underlying foundation. In this application the tool housing, accommodating the nozzle body 2, a nozzle assembly 19, and the swivel mechanism, is provided with a T-shaped advance and guide element 20 which is received and guided in a T-section guideway 21 and movable at a predetermined advance speed. With a vertical swivel drive, the nozzle makes a cut along a horizontal path in the upper surface of constructional part 25.

By means of the liquid jet discharged from the blade structure through a narrow slot 16, nozzle assembly 19 produces a cut between the paving coat and the foundation, and the blade structure dislodges the paving coat from the foundation in slices.

The supply of the nozzle with high pressure liquid and of the swivel drive with operating liquid is effected through supply lines 22 from a motor driven pumping unit 23 including a liquid pump for the jet and a hydraulic pump for the swivel drive. The liquid pump takes in the liquid through a suction line 24.

Figure 5:
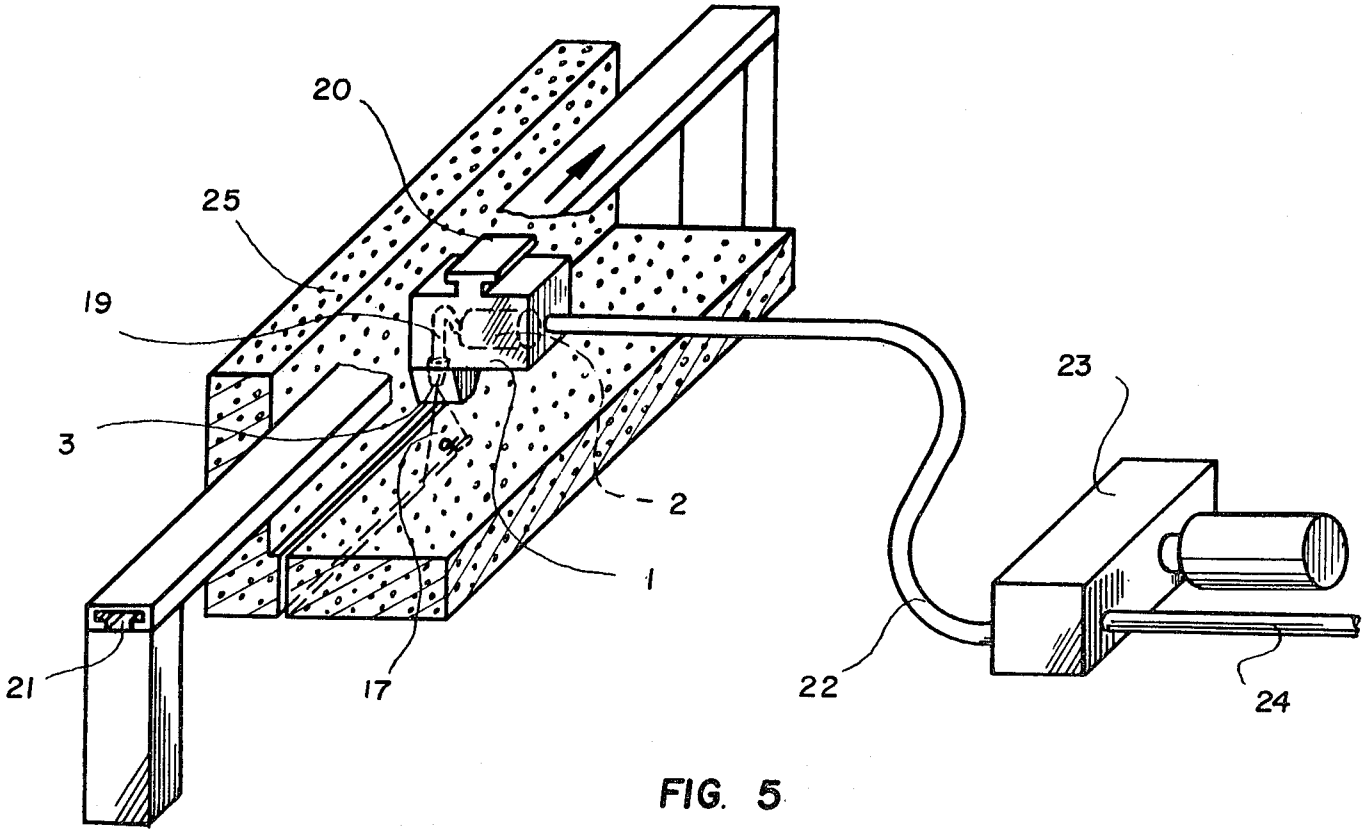
FIG. 5 is a perspective view, similar to FIG. 4, showing the tool as used for making a vertical cut in a structural part.

FIG. 5 shows a tool with a horizontally arranged nozzle assembly 19 for vertically cutting a constructional part 25, with the advance and guide element 20 and supply lines 22 and pumping unit 23 being designed as in FIG. 4.

Figure 6:
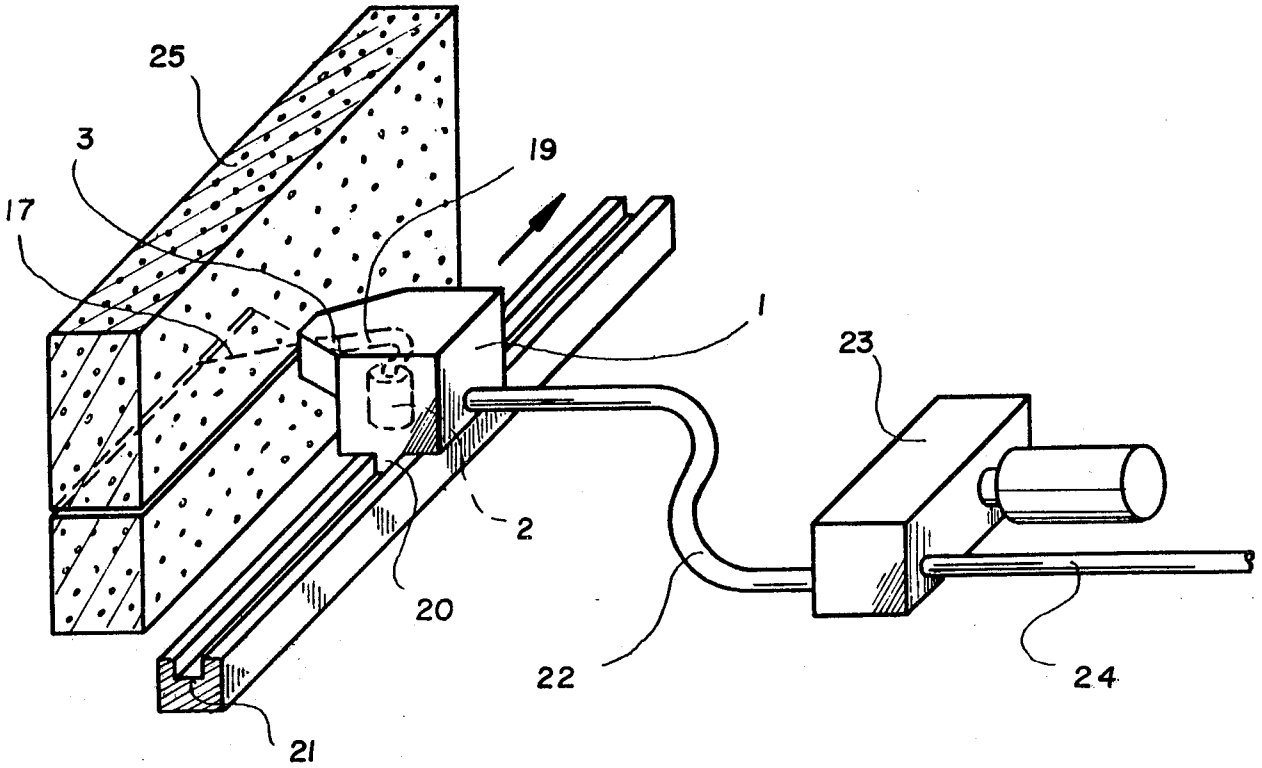
FIG. 6 is a view, similar to FIGS. 4 and 5, showing the tool as used for making a horizontal cut in a structural part.

FIG. 6 shows a tool with a vertically arranged nozzle assembly 19 for cutting a constructional part 25 horizontally.

Figure 7:
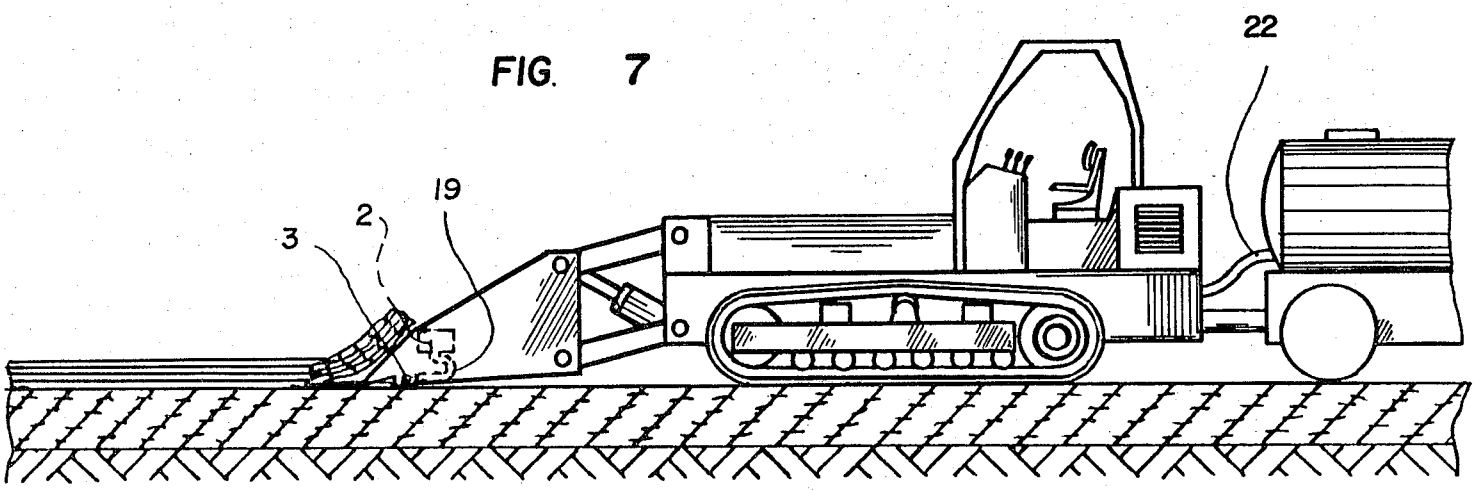
FIG. 7 is a side view showing the tool as incorporated in a constructional vehicle.

Another application is shown in FIG. 7. There, nozzle assembly 19 is accommodated in an entirely closed blade structure of a scraper. By means of a liquid jet discharge through a narrow slot in the blade structure, nozzle assembly 19 cuts the road to dislodge the paving coat from the foundation or to remove the coat by slices.

In this application, nozzle assembly 19 is supplied from a pumping unit carried on a trailer.

Thus, in accordance with the invention, a tool for hydromechanical or hydraulic mining or for cutting mineral or bituminous materials, includes a housing 1, a swivel nozzle body 2, with a nozzle 3, and a swivel drive, and is characterized by the fact that the nozzle body 2 is is provided with a cylindrical part, symmetrical about the swivel axis with a coupling element 5 driven by a swivel drive and accommodated in a sealed space. The nozzle body 2 preferably has an upper, shaft-end portion mounted for swiveling in a bore which is provided with a circular channel 6 communicating with a central bore 8 of the upper, shaft-end portion of the nozzle body through at least one bore 7 radially extending in the shaft end portion in the zone of the circular channel. The swivel drive 4 preferably includes an eccentric 9 which is driven by a motor and by which a sliding member 10 is reciprocated in translational motion on a guide 11 extending transversely to the longitudinal axis of the tool.

In accordance with a preferred embodiment, the sliding member 10 is hinged to a projection of the swiveling nozzle body 2 through a coupling bar 12 which has a forked end and is displaceable in its longitudinal direction and through coupling elements 5.

The nozzle 3 is preferably provided at the lower end of the cylindrical nozzle body 2 and extends perpendicularly or substantially perpendicularly to the swivel axis, and that the nozzle orifice is provided near the swivel axis. In one embodiment, the nozzle 3 is cylindrical and provided with an annular groove for receiving a seal ring.

The nozzle 3 is inserted in a receiving bore provided at the lower end of the nozzle body 2. The position of the nozzle 3 is preferably fixed by a cylindrical element 13 engaged over the lower end of the nozzle body 2. The cylindrical element 13 swivels in a socket 14 of soft material. The sliding surface of the cylindrical element 13 is hardened or coated with a ceramic material. A socket 14 of soft material is preferably pressed into a removable cover 15 of the housing.

A narrow slot 16 covering a jet sweeping angle alpha of up to ±40° is provided in both the housing cover 15 and the socket 14 of soft material.

The nozzle body 2 accommodates a plurality of nozzles which are located at predetermined distances and have their axes oriented in the same direction.

In operation, the rotary motion, which is transformed within the tool by the swivel drive mechanism 4 into an oscillatory motion of the nozzle 3, is introduced either directly through a torque motor of any kind or indirectly from remote drives, through a flexible or articulated shaft.

The tool can be provided with drive and advance elements 20.

The parts of the tool, i.e., the transmission of the rotary motion, the nozzle body unit, the swivel drive mechanism, and the drive unit are self-contained subassemblies.

In accordance with a preferred embodiment, swiveling motion is imparted to the nozzle body directly by a torque motor of any kind, and that the nozzle body be designed as a part of this torque motor.

While specific embodiments of the invention have been shown and described in detail to illustrate the application of the principles of the invention, it will be understood that the invention may be embodied otherwise without departing from such principles.

What is claimed is:

1. A tool for cutting a material along a path with a liquid jet directed onto the material comprising a housing having an interior chamber, said housing having an opening communicating with said chamber, a nozzle body, means for mounting said nozzle body to said housing through said opening for swiveling motion about a swivel axis, said nozzle body having a first portion including a cylindrical stem symmetrically disposed about the swivel axis within said chamber and a second portion extending through said opening including a nozzle having a nozzle bore for discharging the liquid jet, drive means operatively connected to said first portion for swiveling said nozzle body about the swivel axis, and means defining a fixed circular channel about said stem, said stem having a lengthwise bore therein which is symmetrical with the swivel axis and in communication with said nozzle bore and at least one radial bore radially extending through said stem to establish fluid communication between said circular channel and said lengthwise bore.

2. A tool according to claim 1, wherein said nozzle has a cylindrical body with an annular groove with a sealing ring received within said annular groove in sealing engagement with said nozzle body, said nozzle body having a smooth receiving bore provided at the lower end thereof for receiving said nozzle, said nozzle bore extending substantially perpendicular to the swivel axis and further comprising a nozzle orifice mounted adjacent said swivel axis.

3. A tool according to claim 1, wherein said housing includes a guide element extending outwardly therefrom, and means defining a guideway on which said guide element is slidably engaged, said guideway extending on a path of movement in which said housing is to be advanced.

4. A tool according to claim 3, wherein said guide element is T-shaped and said guideway has a T-shaped cross section for receiving said T-shaped guide element.

5. The tool according to claim 1, wherein said drive means comprises an eccentric member mounted in said chamber for rotation, a sliding member slidably mounted to said housing, said sliding member being operatively connected to said eccentric member and said nozzle body and being operable to slide in linear movement transversely to the swivel axis, and said nozzle body being operable to swivel responsive to the linear movement of said sliding member.

6. The tool according to claim 5, wherein said nozzle body, said drive means and said mounting means are sealingly enclosed within said housing, said drive means includes a coupling bar displaceably received in said sliding member, and means for hingedly connecting said coupling bar to said nozzle body.

7. A tool according to claim 6, wherein said drive means further includes an additional sliding member slidably mounted to said former-mentioned sliding member for movement transverse to the linear movement of said former-mentioned sliding member, said additional sliding member rotatably connected to said eccentric member for transmitting rotation of said eccentric member into linear movement of said former-mentioned sliding member.

8. A tool according to claim 7, wherein said eccentric member is mounted for rotation in said chamber on an axis which is transverse to said linear movement of said former-mentioned sliding member and to said swivel axis.

9. A tool for cutting a material along a path with a liquid jet directed onto the material comprising a housing having an interior chamber, said housing having an opening communicating with said chamber, a nozzle body, means for mounting said nozzle body to said housing through said opening for swiveling motion about a swivel axis, said nozzle body having a first portion including a cylindrical stem symmetrically disposed about the swivel axis within said chamber and a second portion extending through said opening including a nozzle having a nozzle bore for discharging the liquid jet, drive means operatively connected to said first portion for swiveling said nozzle body about the swivel axis, said nozzle bore extending substantially perpendicular to the swivel axis and further comprising a nozzle orifice mounted adjacent said swivel axis, said mounting means including a cylindrical element engaged over the lower end of said nozzle body.

10. A tool according to claim 9, wherein said mounting means includes a socket slidably supporting said cylindrical element, said socket having a lining of a soft material.

11. A tool according to claim 10, wherein said cylindrical element has a surface in sliding engagement with said socket which is composed of a hardened material.

12. A tool according to claim 11, wherein said hardened material is a ceramic material coating.

13. A tool as set forth in claim 10, wherein said mounting means includes a removable cover for substantially closing said opening, said socket being press-fitted into said removable cover.

14. A tool according to claim 13, wherein each of said cover and said socket includes a narrow slot having a jet sweeping angle alpha of up to 80°.

15. A tool according to claim 9, wherein said nozzle body includes a plurality of said nozzles located at predetermined distances, each of said nozzles having its nozzle axis oriented in the same direction.

16. A tool according to claim 15, further comprising means for mounting said tool to a guideway.

* * * * *